US007837431B2

(12) United States Patent
Nishi et al.

(10) Patent No.: US 7,837,431 B2
(45) Date of Patent: Nov. 23, 2010

(54) IMPELLER AND SEWAGE TREATMENT PUMP INCLUDING THE SAME

(75) Inventors: Yasuyuki Nishi, Hyogo (JP); Chikara Takebe, Hyogo (JP); Koichi Tamura, Hyogo (JP); Yoichi Tamaki, Hyogo (JP); Akihiro Ando, Hyogo (JP); Arata Funasaka, Hyogo (JP)

(73) Assignee: Shinmaywa Industries, Ltd. (JP)

( * ) Notice: Subject to any disclaimer, the term of this patent is extended or adjusted under 35 U.S.C. 154(b) by 0 days.

(21) Appl. No.: 10/879,750

(22) Filed: Jun. 30, 2004

(65) Prior Publication Data

US 2005/0013688 A1 Jan. 20, 2005

(30) Foreign Application Priority Data

Jul. 18, 2003 (JP) ..... 2003-277163

(51) Int. Cl.
*F04D 1/04* (2006.01)
*F04D 29/22* (2006.01)

(52) U.S. Cl. ..... 415/71; 415/206; 416/177; 416/186 R

(58) Field of Classification Search ..... 415/71, 415/72, 73, 75, 204, 206; 416/19, 176, 177, 416/179, 186 R, 223 B
See application file for complete search history.

(56) References Cited

U.S. PATENT DOCUMENTS 1,754,992 A * 4/1930 Fabrin ..... 415/206
1,849,127 A * 3/1932 Wood ..... 415/206
2,272,469 A * 2/1942 Lannert ..... 416/186 R
2,396,083 A * 3/1946 Chase ..... 415/206
2,655,868 A * 10/1953 Lindau et al. ..... 415/71
2,741,992 A * 4/1956 Glazebrook ..... 415/71

(Continued)

FOREIGN PATENT DOCUMENTS

EP 1258635 A1 11/2002

(Continued)

OTHER PUBLICATIONS

Japanese Office Action "Notice of Reasons for Rejections" with Mailing date of Aug. 18, 2009 Patent Application No. 2003-277163 with English Translation.

(Continued)

*Primary Examiner*—Edward K. Look
*Assistant Examiner*—Nathaniel Wiehe
(74) *Attorney, Agent, or Firm*—Studebaker & Brackett PC; Donald R. Studebaker

(57) ABSTRACT

In an impeller 11, an inlet portion and an outlet portion are provided at one end side and the other end side in the axial direction, respectively. An inlet 29 is formed in the lower part of the inlet portion, and an outlet is formed in the side face of the outlet portion. The inlet portion and the outlet portion are partitioned by a flange portion 40. The impeller 11 includes a primary vane 36 and a secondary vane 38. The primary vane 36 defines a spiral primary channel 35 that connects the inlet 29 and the outlet. The secondary vane 38 is formed in a shape that a part of the outer periphery of the outlet portion is gouged inward so as to define a secondary channel 37 connected to the primary channel 35 and extending circumferentially around the outer periphery.

9 Claims, 15 Drawing Sheets

U.S. PATENT DOCUMENTS

| | | | | | |
|---|---|---|---|---|---|
| 2,853,019 | A | * | 9/1958 | Thornton | 415/71 |
| 4,575,312 | A | * | 3/1986 | Erikson | 416/179 |
| 4,681,508 | A | * | 7/1987 | Kim | 415/206 |
| 5,348,444 | A | * | 9/1994 | Metzinger et al. | 416/179 |
| 6,837,684 | B2 | * | 1/2005 | Ilves | 416/177 |

FOREIGN PATENT DOCUMENTS

| | | | | | |
|---|---|---|---|---|---|
| FI | 42799 | A | * | 6/1970 | 416/179 |
| FR | 1274289 | A | * | 9/1961 | 416/223 B |
| JP | 28-5840 | | | 4/1950 | |
| JP | 57-40691 | U | | 3/1982 | |
| JP | 11-006496 | A | | 1/1999 | |

OTHER PUBLICATIONS

Second Office Action mailed Jul. 25, 2008 in the corresponding Chinese patent application with translation.

* cited by examiner

IMPELLER AND SEWAGE TREATMENT PUMP INCLUDING THE SAME

CROSS REFERENCE TO RELATED APPLICATIONS

This Non-provisional application claims priority under 35 U.S.C. §119(a) of Patent Application NO. 2003-277163 filed in Japan on Jul. 18, 2003, the entire contents of which are hereby incorporated by reference.

BACKGROUND OF THE INVENTION

1. Field of the Invention

The present invention relates to impellers and sewage treatment pumps including the same.

2. Description of the Prior Art

As impellers of sewage treatment pumps, impellers of vortex type, non-clogging type and screw type have been used dominantly. Additionally, an impeller in which a spiral channel is formed inside has been known (see Japanese Patent Publication No. 28-5840B).

In pumps for treating sewage with which foreign matter such as contaminants is mixed, involvement of such foreign matter and choking inside the impellers are liable to be caused, especially in low flow rate regions.

SUMMARY OF THE INVENTION

The present invention has its object of providing an impeller having a spiral channel which prevents involvement of foreign matter and choking inside thereof even in a low flow rate region and which exhibits sufficient pumping efficiency, and providing a sewage treatment pump including it.

The impeller of the present invention is a substantially cylindrical impeller in which an inlet is formed at one end, an outlet is formed at the other end and a spiral channel connecting the inlet and the outlet is defined and formed inside.

The above impeller includes: a flange portion which projects outward from the outer periphery at a part nearer the inlet than the outlet and by which the inlet side and the outlet side are partitioned; a primary vane that defines the spiral channel; and a secondary vane which is formed in a shape that a part of the outer periphery on the outlet side with respect to the flange portion is gouged inward and which defines a secondary channel connected to the spiral channel and extending around the outer periphery.

The above impeller is of the so-called closed type in which the inlet side and the outlet side are partitioned by the flange portion. Therefore, contaminants are less involved and choking occurs less inside the impeller. Since the channel (primary channel) from the inlet to the outlet is formed spirally, a sewage stagnating region inside the impeller is minimized and contaminants smoothly flow through the spiral channel. Hence, contaminants do not remain in the impeller.

The secondary vane is provided in the above impeller, so that the secondary channel is formed which is connected to the spiral channel and formed around the outer periphery. With this configuration, sewage sucked from the inlet is conveyed by both the primary vane and the secondary vane. As a result, the discharge pressure becomes high and the pumping efficiency is increased.

Hence, the above impeller attains both excellent foreign matter passability and increase in pumping efficiency.

In addition, since the secondary vane is formed in a shape that a part of the outer periphery of the impeller is gouged inward, weight reduction is attained compared with impellers having no secondary vane.

Preferably, the secondary vane extends over a length equal to or longer than one half of the circumference of the impeller. With this arrangement, the pumping efficiency is further increased.

It is preferable that the boundary between the outlet end of the primary vane and the inlet end of the secondary vane forms a continuous curve.

It is preferable that the secondary vane is smaller than the primary vane in the vane outlet angle, which is an angle formed between the tip end on the outlet side of the vane and the tangent of the circumference of the impeller.

The secondary channel may be formed substantially circumferentially.

With this configuration, the length in the axial direction of the impeller becomes shorter than that of an impeller in which the secondary channel is formed spirally. Thus, miniaturization of the impeller is progressed.

The sewage treatment pump of the present invention includes: the above impeller; a casing in which an inlet and an outlet are formed and which covers the impeller; and a motor that rotates the impeller.

With this arrangement, a high efficiency pump is achieved in which foreign matter is prevented from clogging.

DESCRIPTION OF THE PREFERRED EMBODIMENTS

The embodiments of the present invention will be described in detail with reference to accompanying drawings.

Figure 1:
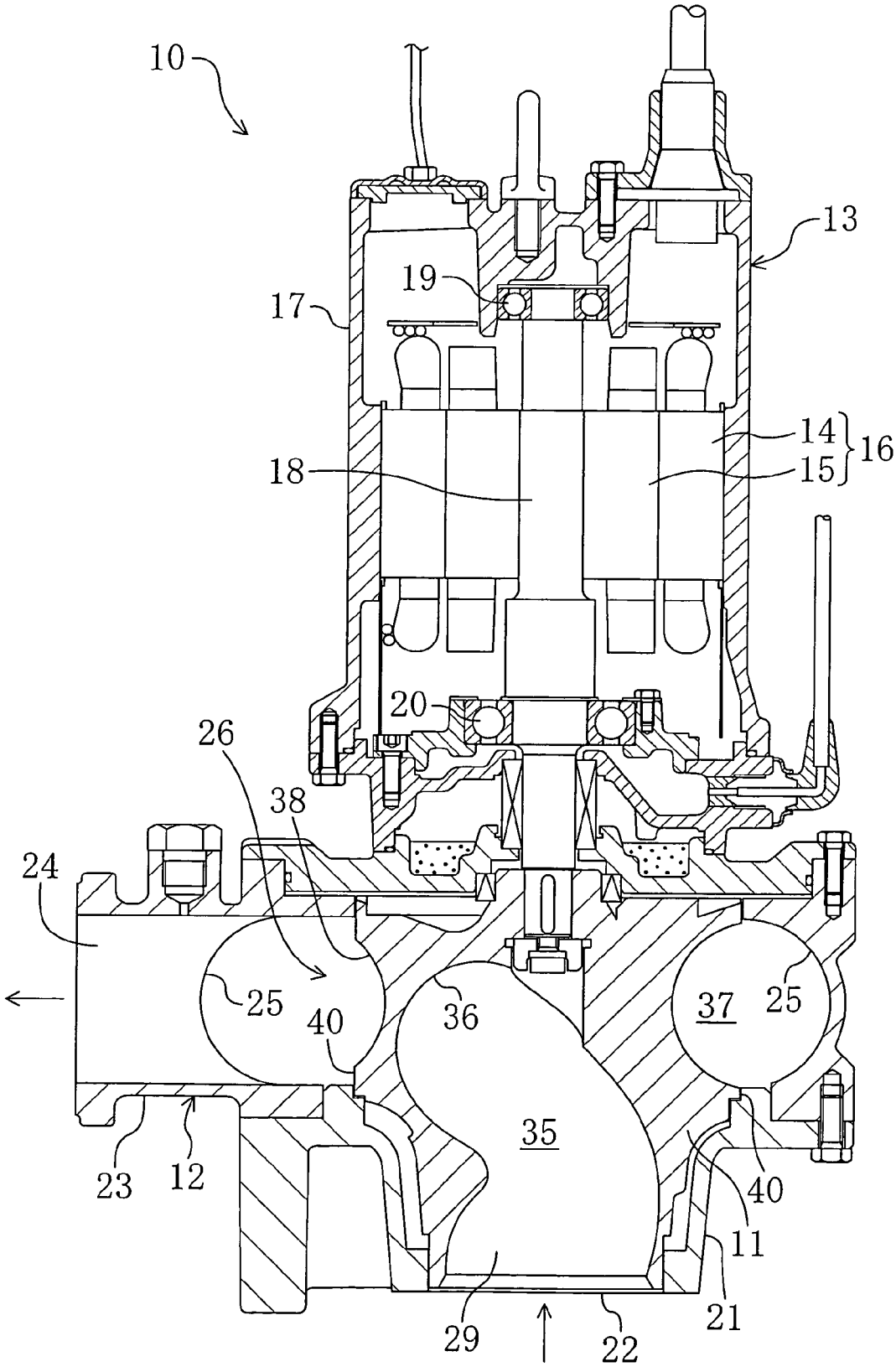
FIG. 1 is a section of a sewage treatment pump.

As shown in FIG. 1, a sewage treatment pump 10 according to the present invention is a submersible turbopump. The pump 10 includes an impeller 11, a pump casing 12 that covers the impeller 11, and a hermetic underwater motor 13 that rotates the impeller 11.

The underwater motor 13 includes a motor 16 composed of a stator 14 and a rotor 15, and a motor casing 17 that covers the motor 16. A drive shaft extending vertically is fixed at the central part of the rotor 15. The drive shaft 18 is rotatably supported at the upper end part thereof and at a slightly lower intermediate part thereof by means of bearings 19 and 20, respectively. The lower end part of the drive shaft 18 is connected to the impeller 11.

A pump chamber 26 is formed inside the pump casing 12 and is defined by an inner wall 25, of which section is hollowed in a half circle shape. An outlet portion 28 of the impeller 11 (see FIG. 2) is accommodated in the pump chamber 26. A sucking portion 21 projecting downward is formed at the lower part of the pump casing 12. A sucking port 22 open downward is formed in the sucking portion 21. A discharge portion 23 projecting sideways is formed at the side of the pump casing 12. At the discharge portion 23, a discharge port 24 open sideways is formed.

Figure 2:
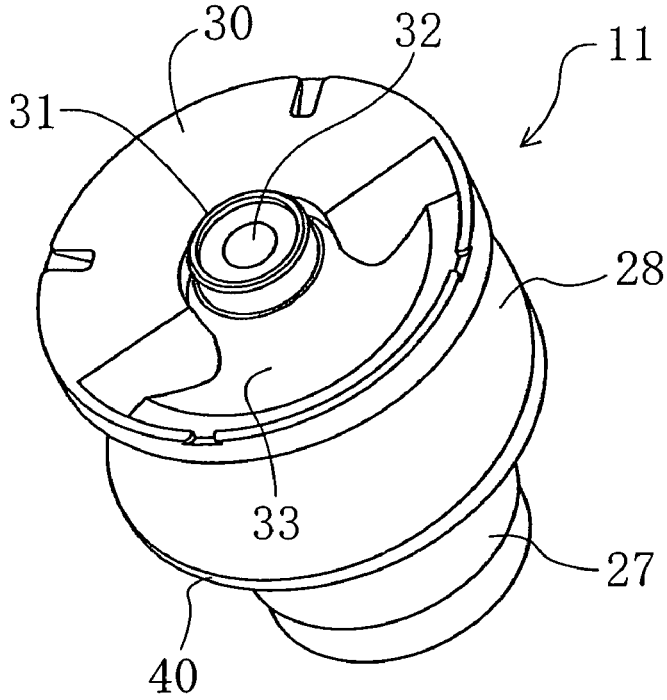
FIG. 2 is a perspective view of an impeller seen from above.

As shown in FIG. 2, the impeller 11 includes the inlet portion 27 and the outlet portion 28 in this order from the lower part to the upper part in the axial direction. The inlet portion 27 and the outlet portion 28 are both formed almost in a cylindrical shape and the outlet portion 28 has a larger diameter than that of the inlet portion 27. The outlet portion 28 and the inlet portion 27 are partitioned by a flange portion 40 projecting outward from the outer periphery of the impeller 11.

Figure 3:
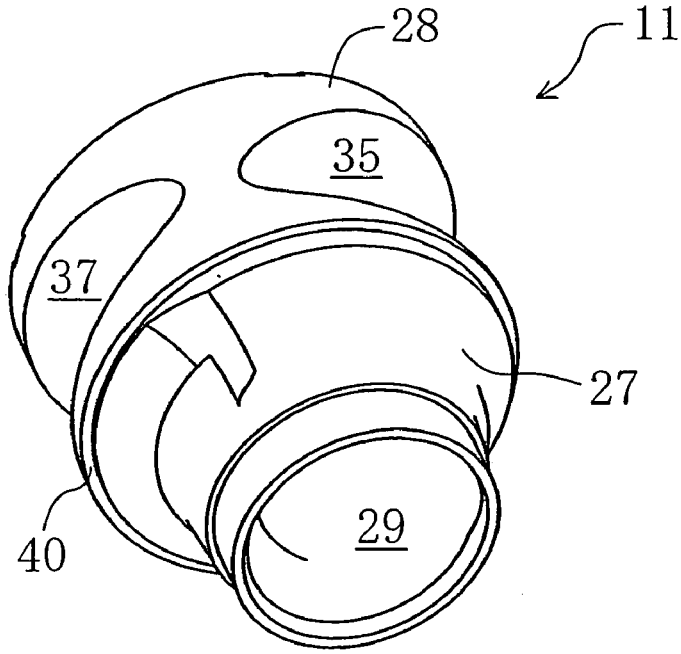
FIG. 3 is a perspective view of the impeller seen from below.
Figure 4:
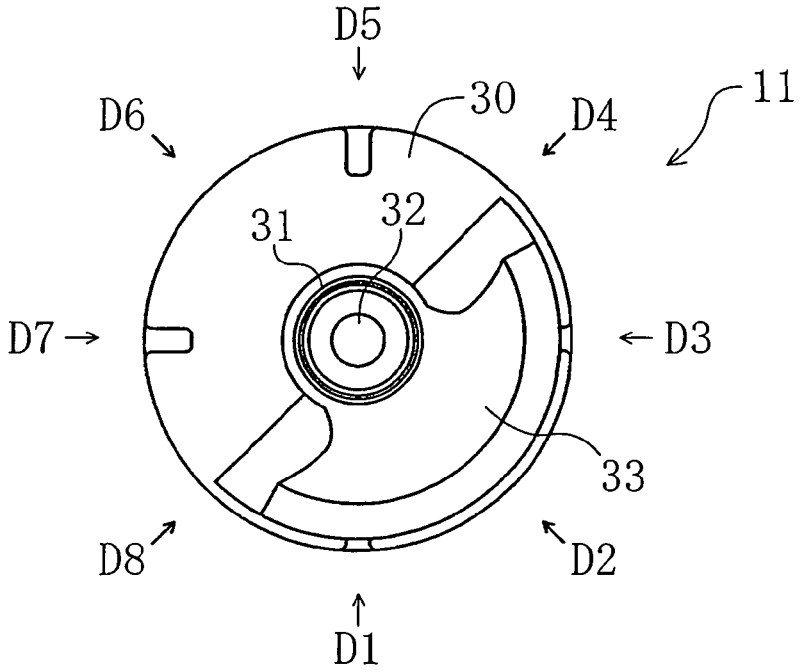
FIG. 4 is a plan view of the impeller.
Figure 5:
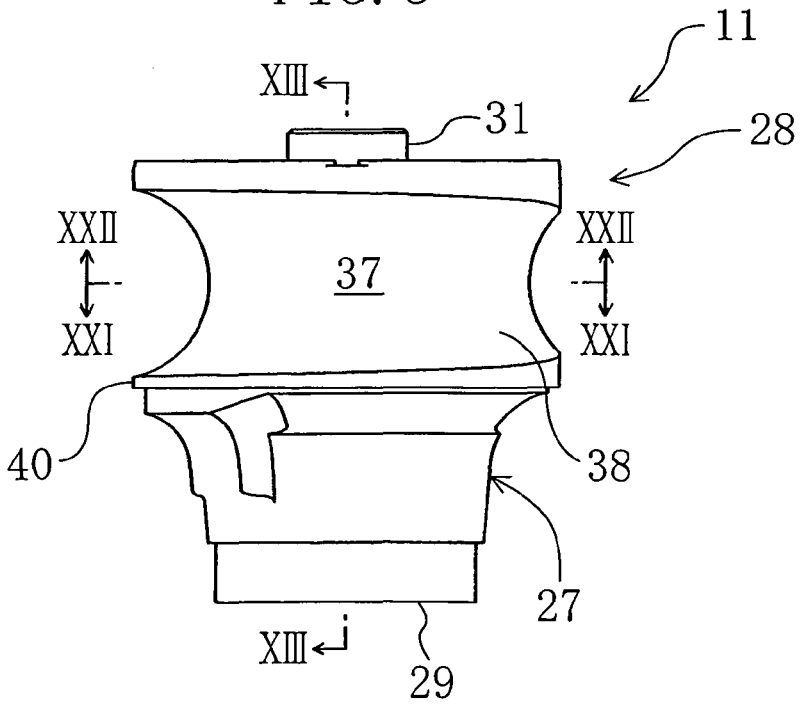
FIG. 5 is a side view seen from an arrow D1 in FIG. 4.

As shown in FIG. 3, an inlet 29 open downward is provided at the lower end of the inlet portion 27. As shown in FIG. 2, an upper end wall 30 covers the upper side of the outlet portion 28. Namely, the upper side of the impeller 11 is sealed by means of the upper end wall 30.

At the central part of the upper wall 30, a hole 32 is formed into which the tip end of the drive shaft 18 is inserted. The peripheral part of the hole 32 is formed into a mounting portion 31 for mounting the drive shaft 18. A part of the upper end wall 30 (herein, a half of the upper end wall 30 ) is recessed downward for balancing the total weight of the impeller 11, thereby enhancing the stability of the rotation. In detail, the upper end wall 30 is formed in a shape that one side thereof (heavier weight side of the impeller 11) is recessed. Wherein, no limitation is imposed on the size and shape of the hollow 33. Further, the hollow 33 is not necessarily formed and the shape of the upper end wall 30 is not specifically limited. The upper face of the upper end wall 30 may be flat.

Figure 21:
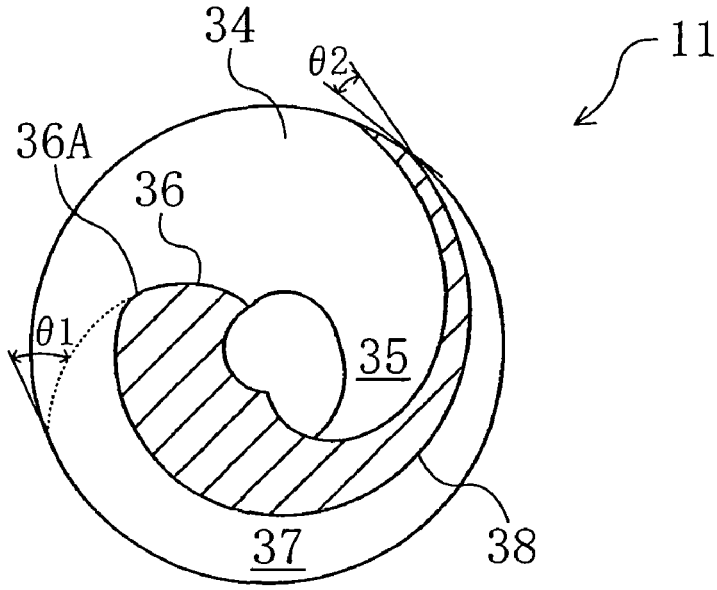
FIG. 21 is a section taken along a line XXI-XXI in FIG. 5.

As shown in FIG. 9 through FIG. 11 and FIG. 21, an outlet 34 is formed at the side of the outlet portion 28. As shown in FIG. 13 through FIG. 20, a spiral primary channel 35 is defined and formed from the inlet 29 to the outlet 34 inside the impeller 11. In the present description, this defining wall that defines the primary channel 35 is called a primary vane 36. It is noted that the outlet 34 is open in a direction that the spiral primary channel 35 extends, as shown in FIG. 21.

A part of the outer periphery of the outlet portion 28 is formed as if it is gouged inward around the outer periphery. Namely, an inwardly recessed channel 37 is formed in the outer periphery of the outlet portion 28 on the downstream side of the primary channel 35 in the outlet portion 28. In other words, the secondary channel 37 connected to the primary channel 35 is formed at a part of the outer periphery of the outlet portion 28. In the present description, this defining wall that defines the secondary channel 37 is called a secondary vane 38.

Figure 6:
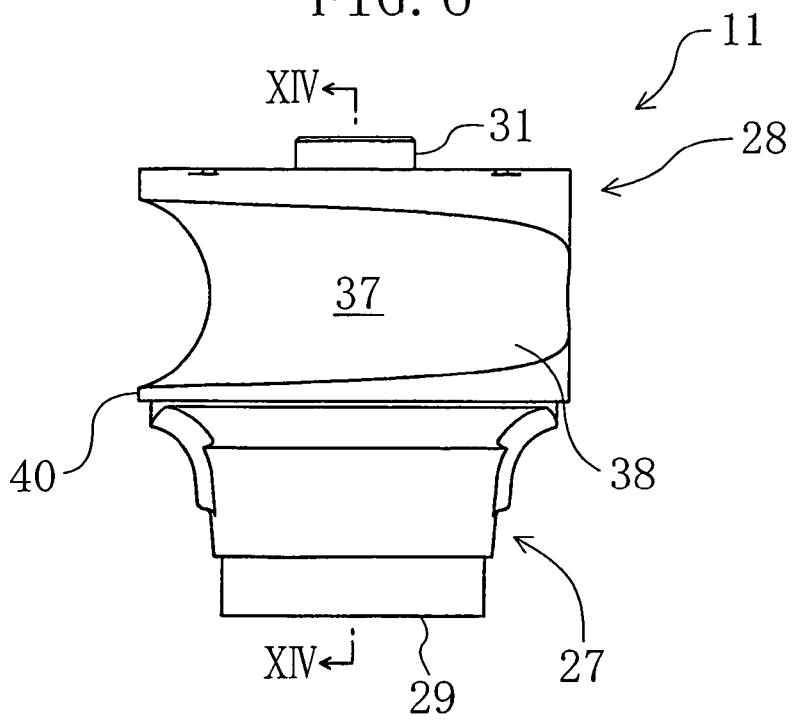
FIG. 6 is a side view seen from an arrow D2 in FIG. 4.
Figure 7:
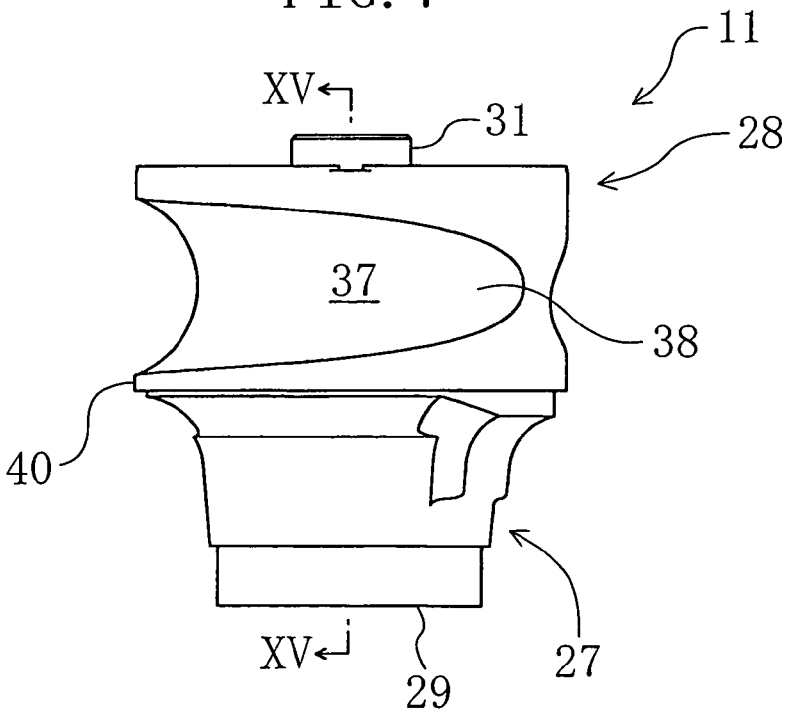
FIG. 7 is a side view seen from an arrow D3 in FIG. 4.
Figure 8:
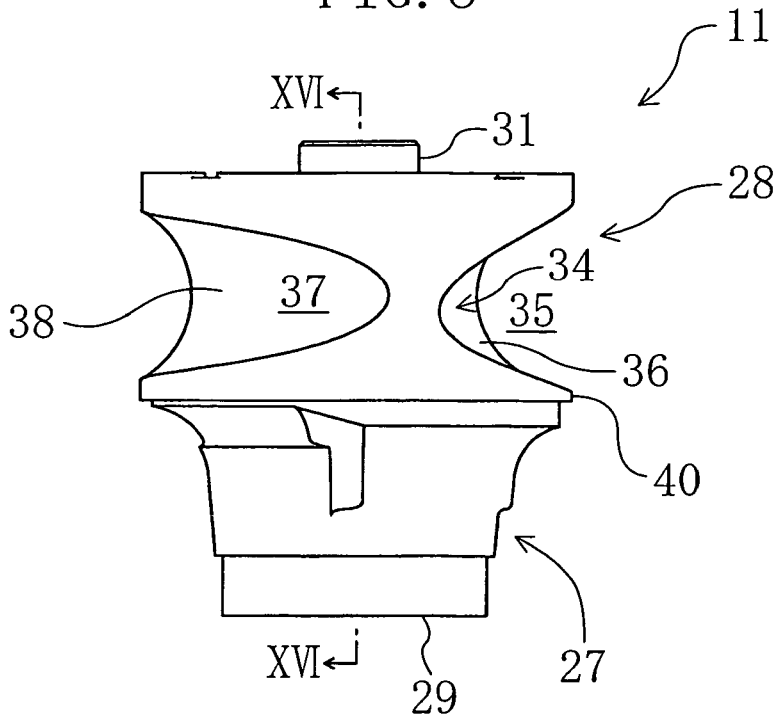
FIG. 8 is a side view seen from an arrow D4 in FIG. 4.
Figure 9:
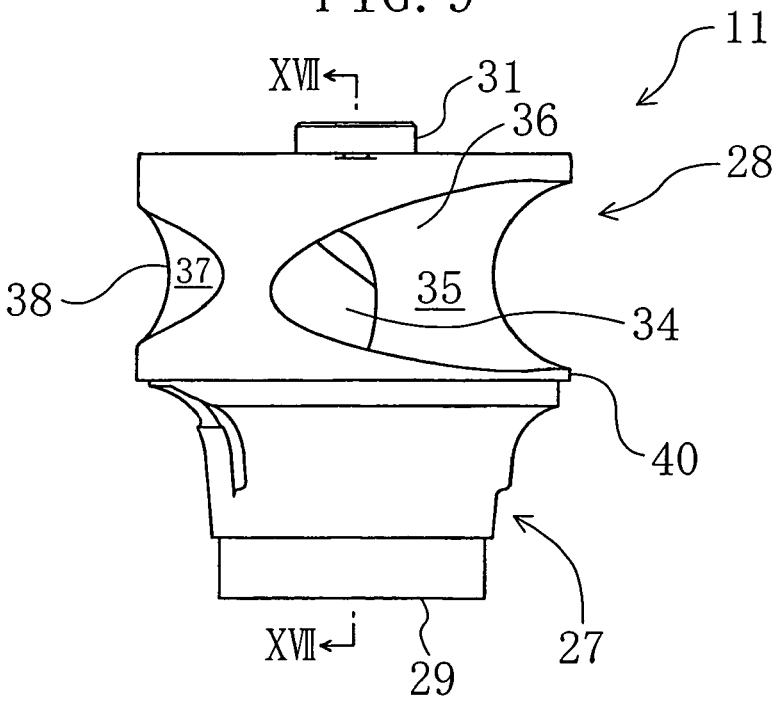
FIG. 9 is a side view seen from an arrow D5 in FIG. 4.
Figure 10:
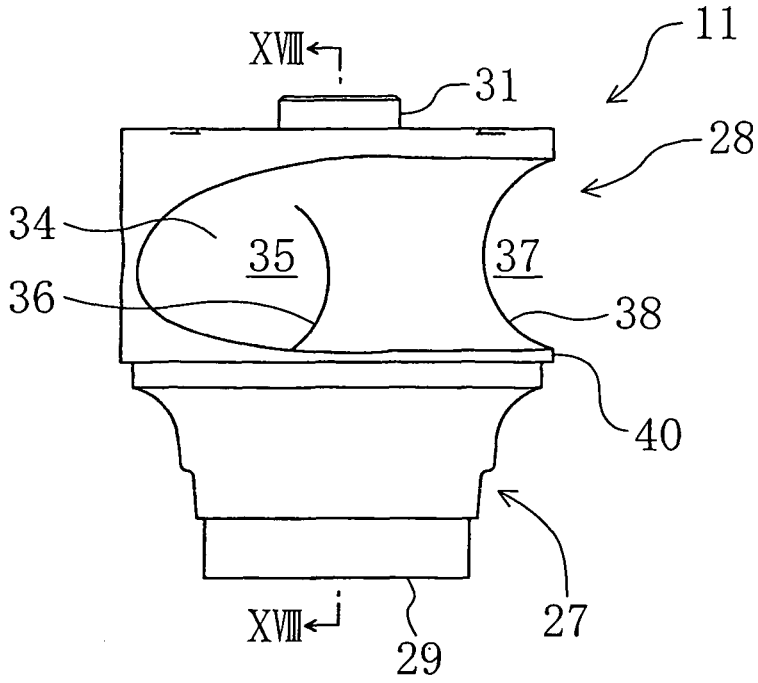
FIG. 10 is a side view seen from an arrow D6 in FIG. 4.
Figure 11:
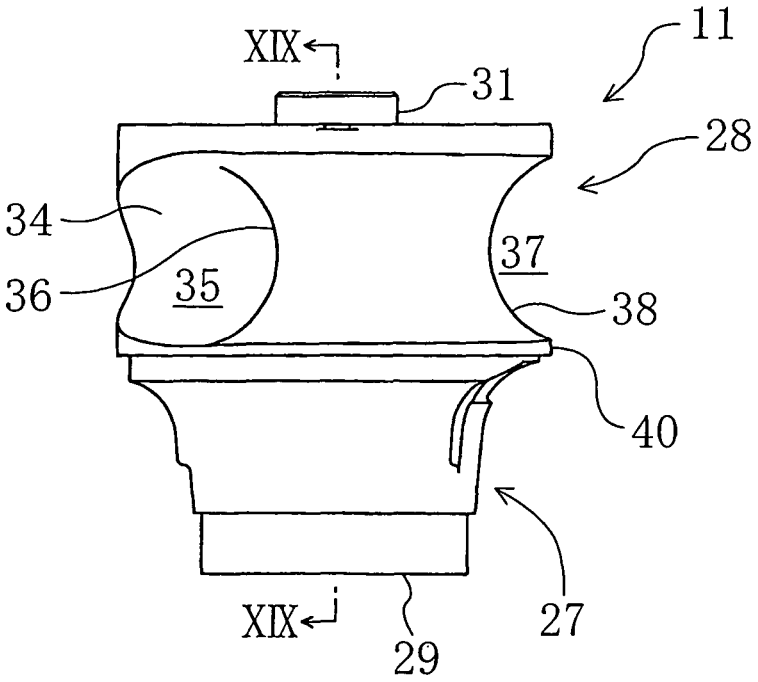
FIG. 11 is a side view seen from an arrow D7 in FIG. 4.
Figure 12:
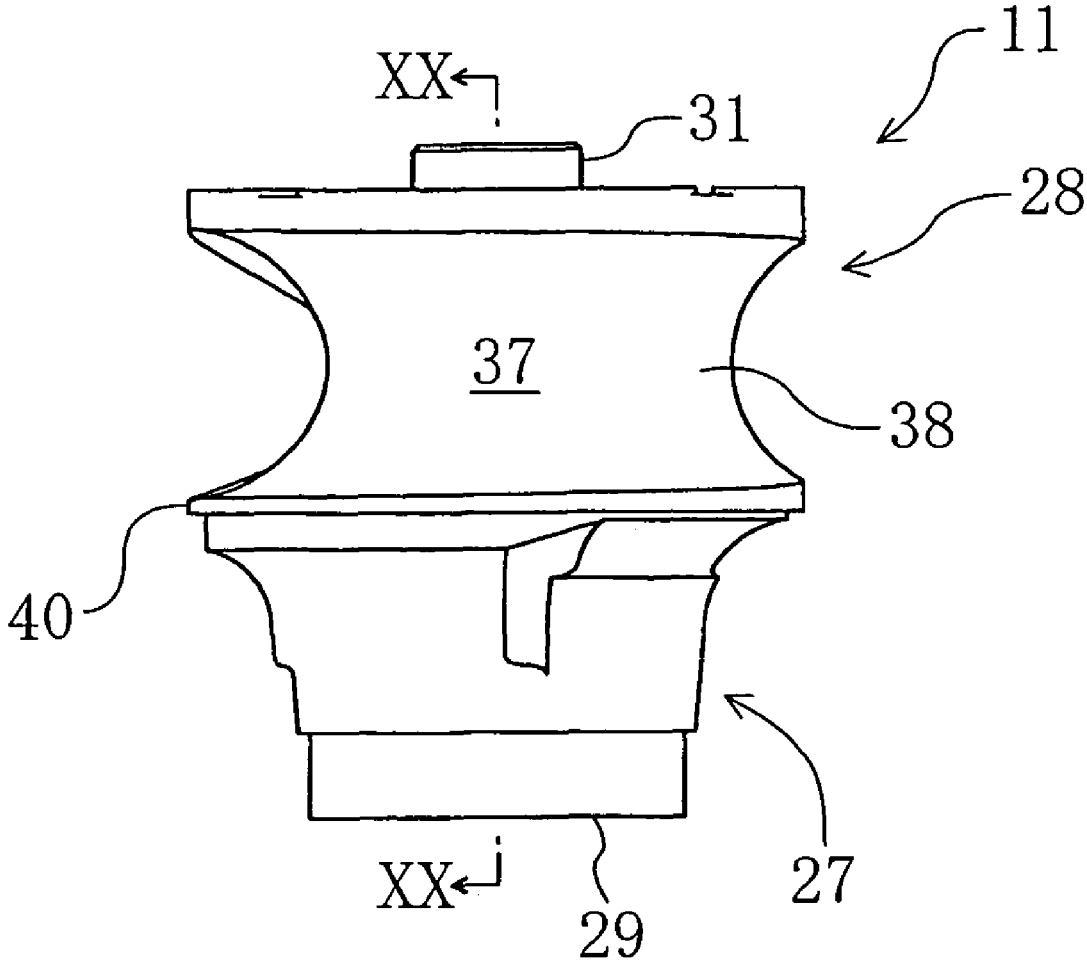
FIG. 12 is a side view seen from an arrow D8 in FIG. 4.
Figure 13:
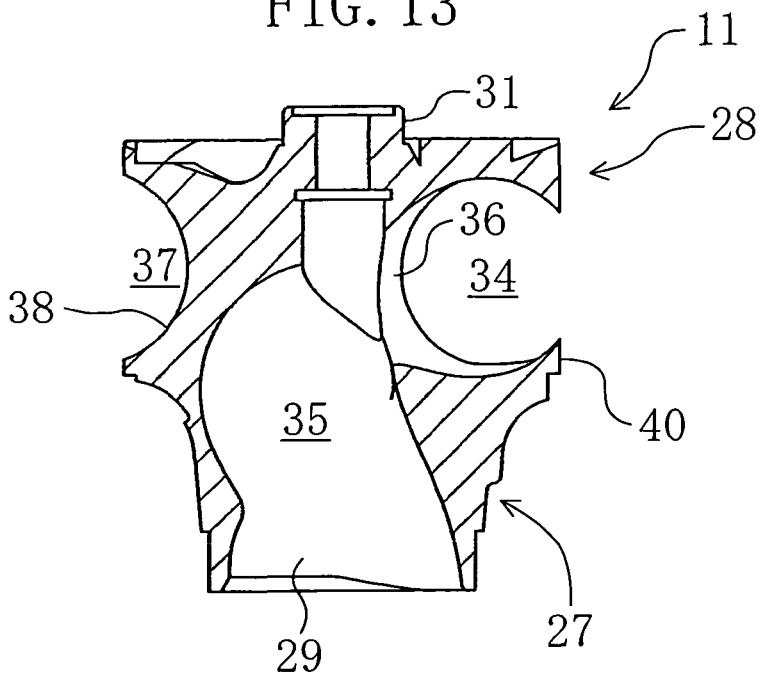
FIG. 13 is a section taken along a line XIII-XIII in FIG. 5.
Figure 14:
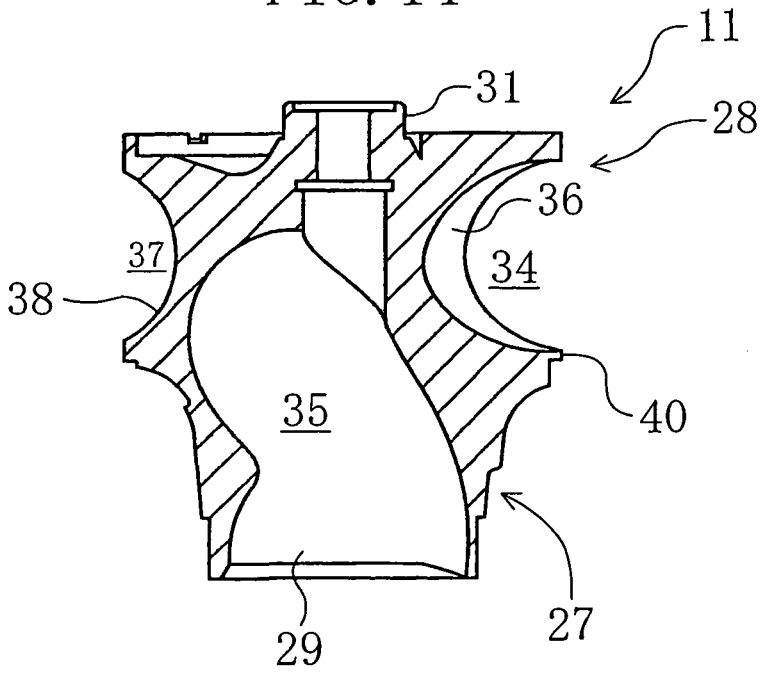
FIG. 14 is a section taken along a line XIV-XIV in FIG. 6.
Figure 15:
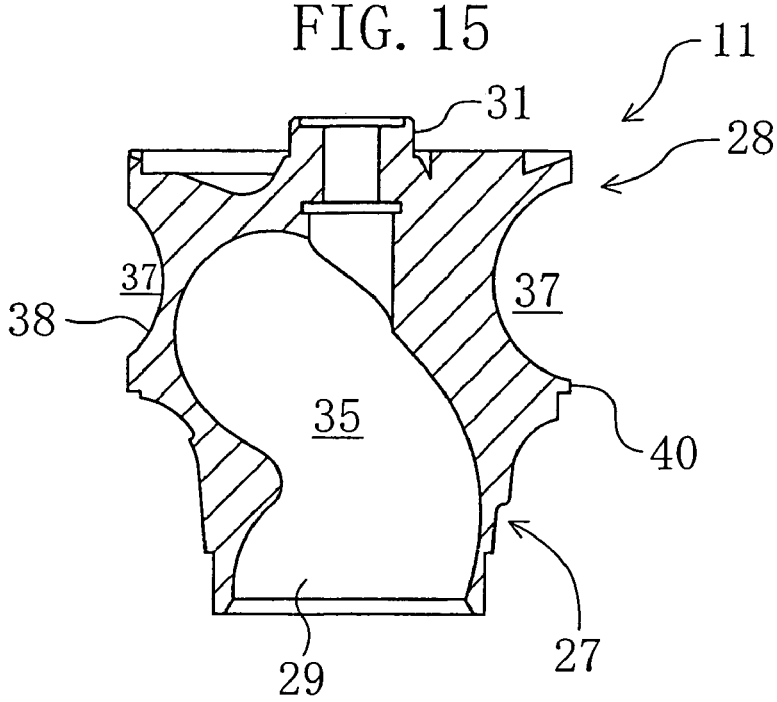
FIG. 15 is a section taken along a line XV-XV in FIG. 7.
Figure 16:
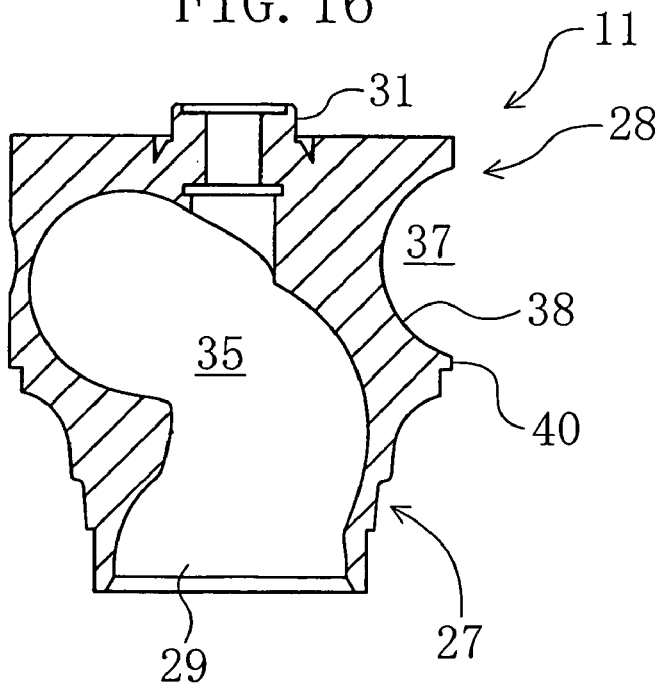
FIG. 16 is a section taken along a line XVI-XVI in FIG. 8.
Figure 17:
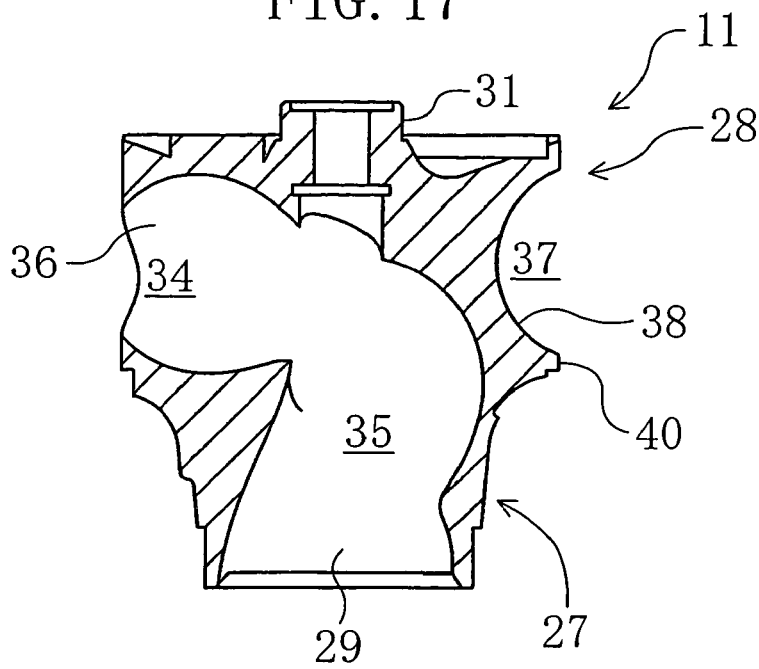
FIG. 17 is a section taken along a line XVII-XVII in FIG. 9.
Figure 18:
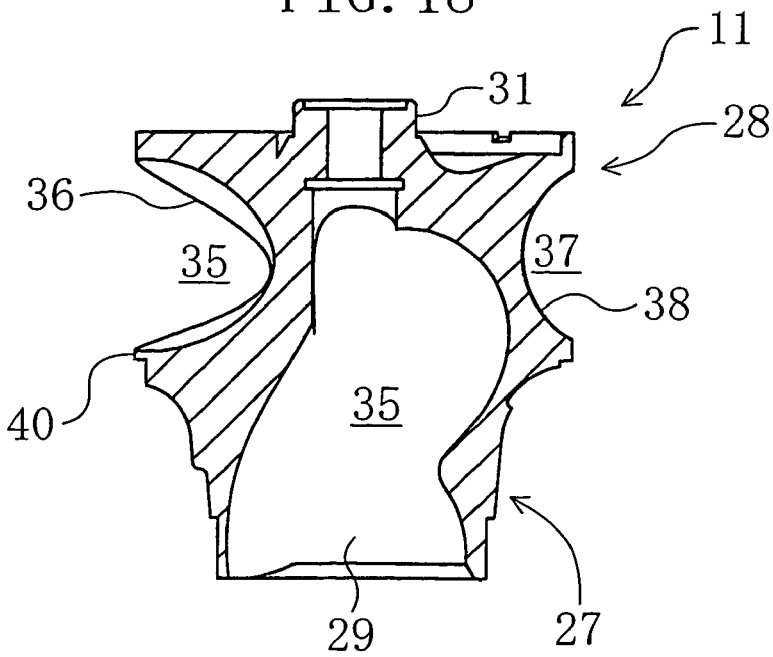
FIG. 18 is a section taken along a line XVIII-XVIII in FIG. 10.
Figure 19:
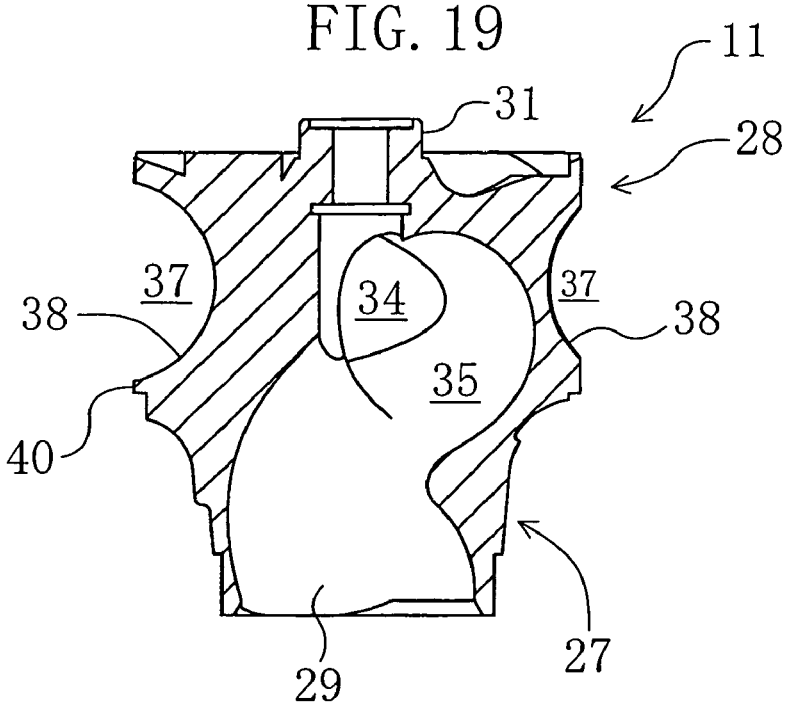
FIG. 19 is a section taken along a line XIX-XIX in FIG. 11.
Figure 20:
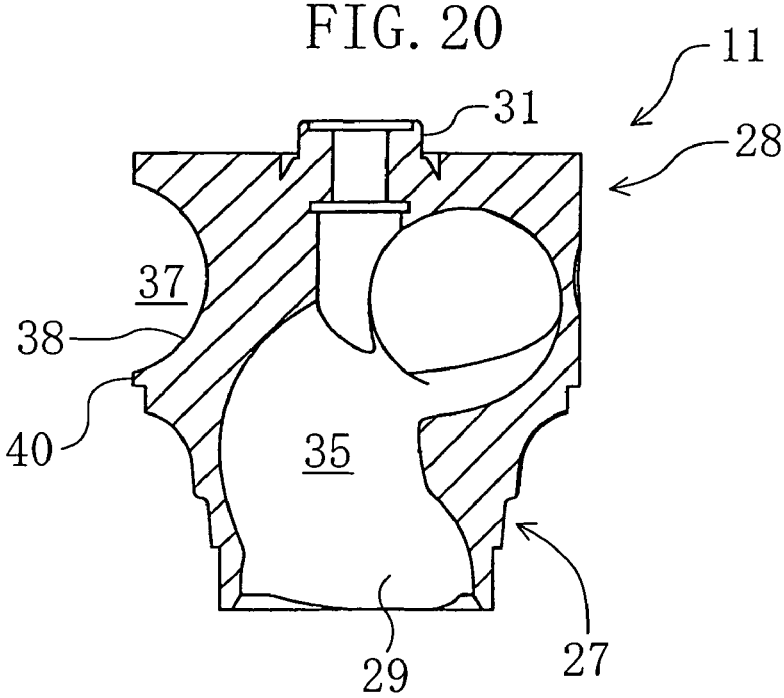
FIG. 20 is a section taken along a line XX-XX in FIG. 12.
Figure 22:
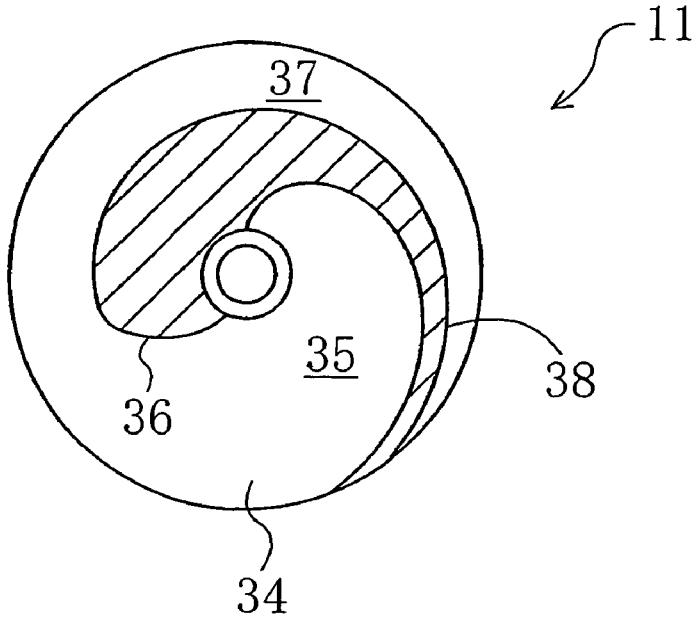
FIG. 22 is a section taken along a line XXII-XXII in FIG. 5.

In the present embodiment, the secondary channel 37 is a non-spiral channel and the center of the channel is located on the same plane intersecting at a right angle with the axial direction. In other words, the secondary vane 38 is a vane of radial flow type and discharges sewage in a direction intersecting at a right angle with the axial direction (radially outward). As shown in FIG. 6 through FIG. 8, the channel width of the secondary channel 37 is narrowed in a downstream direction. In addition, as shown in FIG. 21 and FIG. 22, the thickness of the secondary vane 38 is thinned downstream direction.

In the present embodiment, the secondary channel 37 extends circumferentially around the outlet portion 28 over a length equal to or longer than one half of the circumference of the impeller 11. As shown in FIG. 8, the downstream end of the secondary channel 37 extends to the vicinity of the outlet 34. Preferably, the length of the secondary channel 37 is equal to or longer than one half of the circumference and shorter than the circumference of the impeller 11. Wherein, the length of the secondary channel 37 is not limited specifically.

As shown in FIG. 21, the vane outlet angle 02 of the secondary vane 38 is set smaller than the vane outlet angle 01 of the primary vane 36. Wherein, each vane outlet angle is defined as an angle formed between the tip end on the outlet side of the vane and the tangent of the circumference of the impeller 11. In this impeller 11, the primary channel 35 and the secondary channel 37 are connected to each other so that the tip end (downstream end) 36 A on the outlet side of the primary vane 36 is connected to the upstream end of the secondary vane 38. The boundary between the outlet end of the primary vane 36 and the inlet end of the secondary vane 38 forms a continuous curve. The primary vane 36 and the secondary vane 38 are connected to each other smoothly.

It is noted that vanes are designed generally using predetermined functions that express the curve lines of the vanes. In the present embodiment, the function of the design is different between the primary vane 36 and the secondary vane 38.

A test conducted for confirming the effects obtained by providing the secondary vane 38 is described next.

Figure 23A:
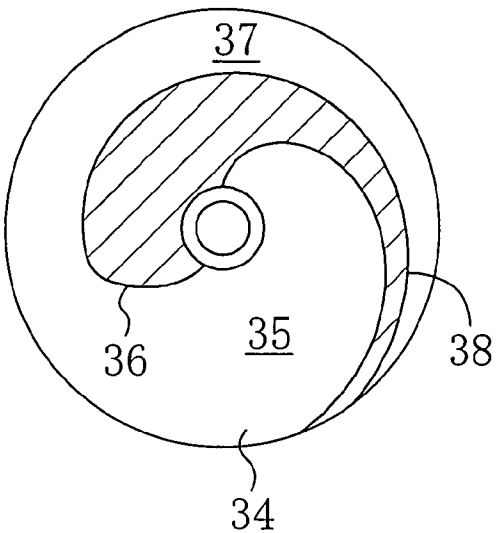
FIG. 23A is an view of an impeller according to Embodiment 1 used in a confirmation test, which is equivalent to FIG. 22.
Figure 23B:
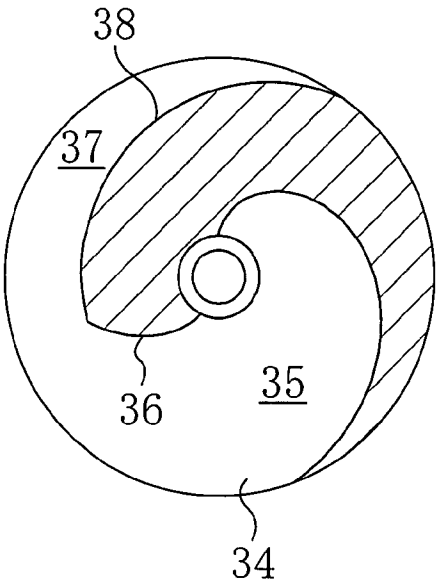
FIG. 23B is a view of an impeller according to Embodiment 2, which is equivalent to FIG. 22.
Figure 23C:
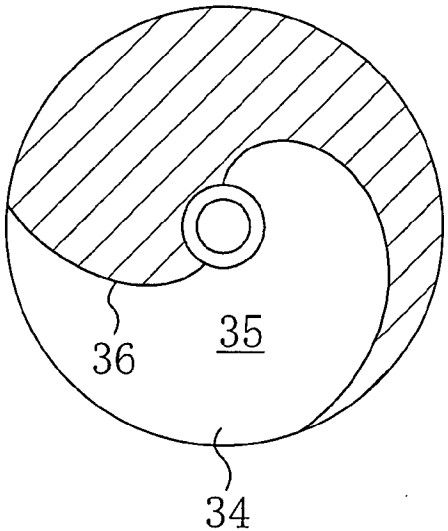
FIG. 23C is a view of an impeller according to a comparative example, which is equivalent to FIG. 22.
Figure 24:
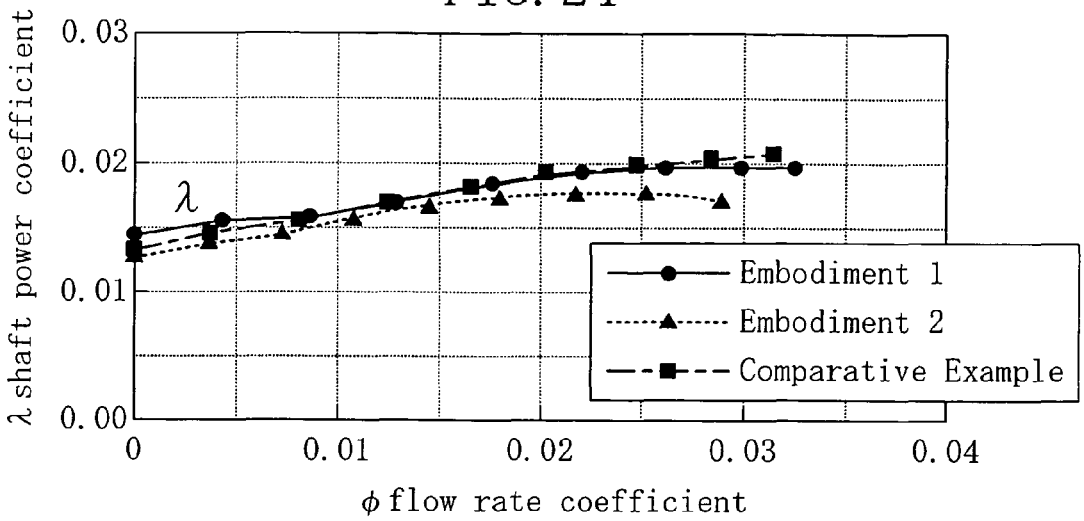
FIG. 24 is a graph showing a relationship between a flow rate coefficient and a shaft power coefficient.
Figure 25:
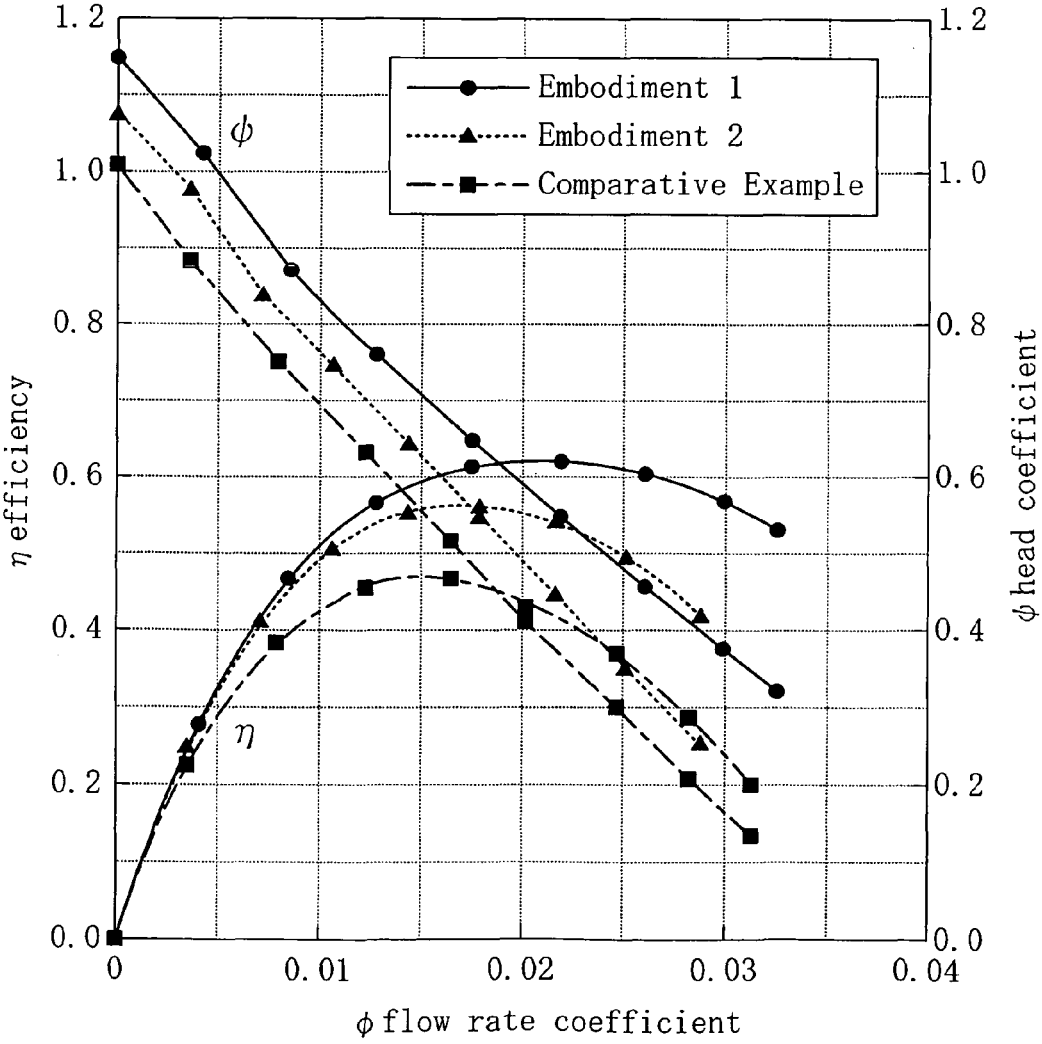
FIG. 25 is a graph showing a relationship among the flow rate coefficient, efficiency and a head coefficient.

As shown in FIG. 23A through FIG. 23C, three impellers were used in this test, namely: an impeller (Embodiment 1, FIG. 23A) in the above embodiment; an impeller (Embodiment 2, FIG. 23B) having a secondary vane 37 of which length is set shorter than that in the above embodiment (specifically, the length of the secondary channel 37 is shorter than one half of the circumference of the impeller 11); and an impeller (Comparative Example, FIG. 23C) having the primary impeller 35 with no secondary impeller 38 provided. The test results are indicated in FIG. 24 and FIG. 25.

Wherein, each parameter is as follows.

Flow rate coefficient: $\phi=Q/(2\pi R_2 b_2 U_2)$

Head coefficient: $\psi=H/(U_2^2/2\,g)$

Shaft power coefficient: $\lambda=L/(\rho\pi R_2 b_2 U_2^3)$

Efficiency: $\eta=(\rho gQH)/L$

Circumferential velocity of impeller (m/s): $U_2=2\pi R_2 n/60$

| | | | |
|---|---|---|---|
| Q: | flow rate ($m^3/s$) | H: | total head (m) |
| L: | axial power (W) | n: | rotational speed ($min^{-1}$) |
| $b_2$: | vane outlet width (m) | $R_2$: | radius at outlet of impeller (m) |
| ρ: | water density ($kg/m^3$) | g: | gravity ($m/s^2$) |

As is cleared from FIG. 25, it is confirmed that each impeller (Embodiments 1 and 2) having the secondary vane 38 has greater efficiency η and a greater head coefficient ψ than those of the impeller (Comparative Example) having no secondary vane 38. In addition, the efficiency η and the head coefficient ψ become greater when the length of the secondary channel 37 is set longer.

As descried above, in the present impeller 11, the secondary vane 38 in the shape that the outer periphery of the outlet portion 28 is gouged inward is provided so as to form the secondary channel 37 connected to the spiral primary channel 35. Thus, the total channel length can be set longer while incurring no increase in the size of the impeller 11. Sewage sucked from the inlet 29 is conveyed by both the primary vane 36 and the secondary vane 38, with a result that the discharge pressure is increased and the pumping efficiency is increased.

Since the secondary vane 38 is in the shape that the outer periphery of the outlet portion 28 is gouged, the length in the radial direction of the impeller 11 is shortened. Hence, a compact and light-weighted impeller is achieved.

Further, since the secondary channel 37 is not in the spiral shape but is formed circumferentially in the radial direction, it is unnecessary to set the length in the axial direction of the impeller 11 so longer for forming the secondary channel 37. In consequence, the downsizing and weight reduction of the impeller 11 is ensured or even increased.

On the other hand, the primary channel 35 extending from the inlet 29 to the outlet 34 is in the spiral shape, so that sewage flows smoothly through the primary channel 35 with less sewage stagnating region generated. For this reason, the impeller 11 prevented from being choked with foreign matter such as contaminants contained in the sewage. Accordingly, foreign matter passability is maintained in excellent level, with a result that the efficiency is increased.

In addition, the impeller 11 is a closed type impeller in which the inlet portion 37 and the outlet portion 28 are partitioned by the flange portion 40. In this point, also, involvement of foreign matter is prevented effectively.

MODIFIED EXAMPLES

The impeller and the pump according to the present invention are not limited to the above embodiment and includes various modified examples.

Figure 26:
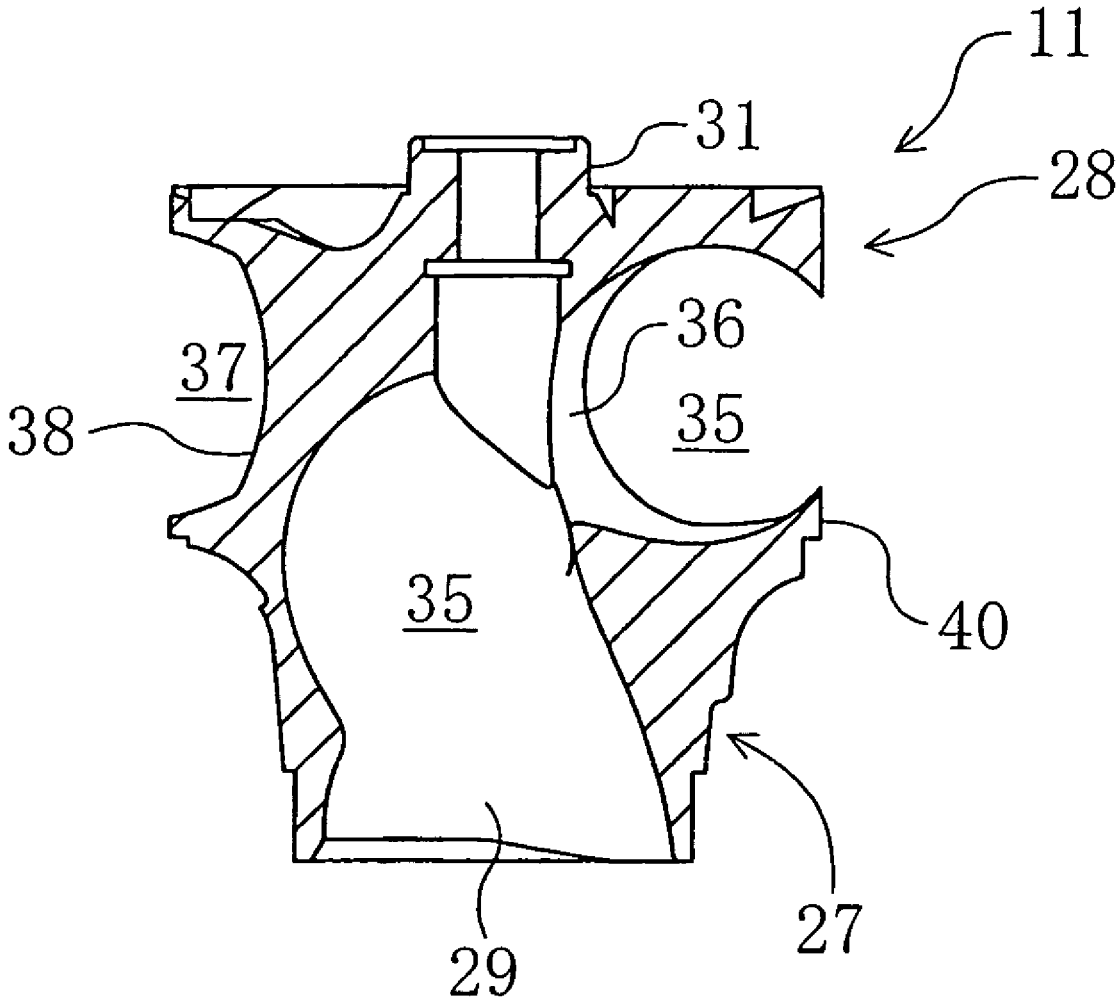
FIG. 26 is a view of an impeller according to a modified example, which is equivalent to FIG. 13.

The shapes in channel section of the primary channel 35 and the secondary channel 37 are not limited to those in the above embodiment. In the above embodiment, the secondary vane 38 has the half circle channel section (FIG. 13), and may have a semi-ellipse channel section or a substantially rectangular shaped channel section (FIG. 26), for examples. No limitation is imposed on the shape in channel section of the secondary vane 38.

The above embodiment uses an impeller of so-called radial flow type in which sewage is discharged in the direction intersecting at a right angle with the axial direction. However, the impeller according to the present invention is not limited to only the radial flow type and may be an impeller of so-called diagonal flow type (or mixed flow type) in which sewage is discharged diagonally upward.

In the above embodiment, the secondary channel 37 is formed substantially circumferentially, but may be formed spirally. In this case, the secondary channel 37 may be formed in a spiral shape expressed by a function different from that of the primary channel 35, and may be formed around the periphery over a length longer than the circumference of the impeller 11.

It should be noted that the impeller 11 is arranged so that the inlet 29 is open perpendicularly downward in the above embodiment, but no limitation is imposed on the arrangement and the direction of the impeller 11. For example, it is possible to arrange the impeller transversely so that the inlet 29 is open in the transverse direction. The "vertical direction" in the above description is a direction determined for the convenience sake and does not limit the actual arrangement.

As described above, the present invention is useful for turbopumps for conveying fluid. Especially, the present invention is useful for sewage treatment pump for conveying sewage containing contaminants and the like.

What is claimed is:

1. A substantially cylindrical impeller in which an inlet is formed at one end of the impeller, an outlet is formed at an outer periphery on another end side and a spiral channel connecting the inlet and the outlet is defined and formed inside of the impeller, comprising:

a flange portion which protrudes outward in a radial direction from the outer periphery at a part nearer the inlet than the outlet, and which partitions the cylindrical impeller into an inlet side and an outlet side;

a primary vane that defines the spiral channel, wherein the spiral channel is a channel starting from the inlet and extending around and along a rotary shaft of the impeller; and a secondary vane which is formed in a shape such that a part of the outer periphery on the outlet side with respect to the flange portion is gouged inward, and which defines a secondary channel connected to the spiral channel and extending around the outer periphery, wherein the primary and secondary vanes are connected to each other so as to provide an abrupt transition between a wall of the primary vane and a wall of the secondary vane.

2. The impeller of claim 1, wherein the secondary channel extends over a length equal to or longer than one half of a circumference of the substantially cylindrical impeller.

3. The impeller of claim 1, wherein a boundary between an outlet end of the primary vane and an inlet end of the secondary vane forms a continuous curve.

4. The impeller of claim 1, wherein an outlet angle of the secondary vane is smaller than that of the primary vane.

5. The impeller of claim 1, wherein the secondary channel is gouged substantially circumferentially.

6. The impeller of claim 1 wherein on a cross section passing a channel center of the secondary channel in which an outer wall and an inner wall defining the spiral channel are observed, an intersection of a virtual line extending from the inner wall and a virtual line extending from a wall defining the secondary channel is located inside the outer periphery of the impeller.

7. The impeller of claim 1, wherein a channel width of the secondary channel is narrowed in a downstream direction.

8. A sewage treatment pump, comprising:

a substantially cylindrical impeller in which an inlet is formed at one end of the impeller, an outlet is formed at an outer periphery on another end side and a spiral channel connecting the inlet and the outlet is defined and formed inside of the impeller, including:

a flange portion which protrudes outward in a radial direction from the outer periphery at a part nearer the inlet than the outlet, and which partitions the cylindrical impeller into an inlet side and an outlet side;

a primary vane that defines the spiral channel, wherein the spiral channel is a channel starting from the inlet and extending around and along a rotary shaft of the impeller;

a secondary vane which is formed in a shape such that a part of the outer periphery on the outlet side with respect to the flange portion is gouged inward, and which defines a secondary channel connected to the spiral channel and extending around the periphery;

a casing in which a sucking port and a discharge port are formed and which covers the impeller; and a motor that rotates the impeller, wherein the primary and secondary vanes are connected to each other so as to provide an abrupt transition between a wall of the primary vane and a wall of the secondary vane.

9. The impeller of claim 1, wherein a boundary between an outlet end of the primary vane and an inlet end of the secondary vane forms a continuous curve.

* * * * *